US007443991B2

(12) United States Patent
Niederdränk et al.

(10) Patent No.: US 7,443,991 B2
(45) Date of Patent: Oct. 28, 2008

(54) ITE HEARING AID FOR BINAURAL HEARING ASSISTANCE

(75) Inventors: Torsten Niederdränk, Erlangen (DE); Joseph Sauer, Strullendorf (DE); Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 607 days.

(21) Appl. No.: 11/095,172

(22) Filed: Mar. 31, 2005

(65) Prior Publication Data

US 2005/0232454 A1 Oct. 20, 2005

Related U.S. Application Data

(60) Provisional application No. 60/557,880, filed on Mar. 31, 2004.

(30) Foreign Application Priority Data

Mar. 31, 2004 (DE) ..... 10 2004 016 573

(51) Int. Cl.
*H04R 25/00* (2006.01)

(52) U.S. Cl. ..... 381/315; 381/328

(58) Field of Classification Search ..... 381/23.1, 381/71.5, 315, 328, 380
See application file for complete search history.

(56) References Cited

U.S. PATENT DOCUMENTS

| | | | | |
|---|---|---|---|---|
| 5,202,927 | A * | 4/1993 | Topholm | 381/315 |
| 5,991,419 | A | 11/1999 | Brander | |
| 6,549,633 | B1 | 4/2003 | Westermann | |
| 6,768,802 | B1 | 7/2004 | Baechler | |
| 7,099,486 | B2 * | 8/2006 | Julstrom et al. | 381/315 |
| 2003/0152243 | A1 | 8/2003 | Julstrom et al. | |

FOREIGN PATENT DOCUMENTS

| | | |
|---|---|---|
| DE | 23 60 342 | 2/1975 |
| DE | 100 48 354 | 5/2002 |
| DE | 102 36 940 | 2/2004 |
| EP | 0 941 014 | 2/1999 |
| WO | WO 99/43185 | 8/1999 |
| WO | WO 03/032682 | 4/2003 |

* cited by examiner

*Primary Examiner*—Brian Ensey
(74) *Attorney, Agent, or Firm*—Schiff Hardin LLP

(57) ABSTRACT

Between ITE hearing aids for binaural hearing assistance, energy-saving communication is made possible by disposing an antenna device with a preferred direction of transmission in the hearing aid housing such that, in a state in which the hearing aid is attached to or inserted one ear of the patient, the preferred direction of transmission is substantially toward the other ear of the patient. In this way it is ensured that the directions of transmission of the two hearing aids in the fitted state lie substantially on a straight line, so that optimum transmission can be achieved.

8 Claims, 2 Drawing Sheets

ITE HEARING AID FOR BINAURAL HEARING ASSISTANCE

This application claims the benefit of U.S. Provisional Application No. 60/557,880, filed Mar. 31, 2004.

BACKGROUND OF THE INVENTION

1. Field of the Invention

The present invention relates to an ITE (in the ear) hearing aid for binaural hearing assistance to a patient, of the type having a housing and an antenna device that has a preferred direction of transmission.

2. Description of the Prior Art

In the case of ITE hearing aids, there is the fundamental problem that only little installation space is available. Therefore, the components that are necessary in ITE hearing aids have to be made as small as possible and/or reduced in number to a minimum.

With binaural hearing assistance, there is also the requirement that the two hearing aids must be made to match each other in their settings. If the ITE hearing aids have arrangements that set themselves automatically to specific hearing situations, the setting of the two hearing aids should take place in such a way that they are made to match.

A hearing aid system with two hearing aids is known from the document German OS 100 48 354, The hearing aids are connected by a bidirectional, wireless signal path. A binaural hearing aid system in which two hearing aids are connected bidirectionally and wirelessly to each other is also known from the patent specification U.S. Pat. No. 6,549,633.

Furthermore, a space-saving antenna arrangement for hearing aid devices is disclosed in the document German OS 102 36 940. In this case, an antenna coil is wound onto the earphone or onto the microphone.

SUMMARY OF THE INVENTION

An object of the present invention is to provide an ITE hearing aid that is capable of communication with another ITE hearing aid.

According to the invention, this object is achieved by an ITE hearing aid for binaural hearing assistance to a patient, with a housing and an antenna device that has a preferred direction of transmission, the antenna device being arranged in the housing such that, in a state in which the hearing aid is attached to or inserted in an ear of the patient, the preferred direction of transmission is substantially toward the other ear of the patient.

According to the invention, for communication between the two hearing aids for binaural assistance, the antenna is fitted in a precisely defined position, i.e. at a specific angle in relation to the housing in the ITE hearing aid. In this way, energy-saving transmission between the two ITE hearing aids can be achieved, since the directions of transmission of the respective antennas of the two hearing aids are made to match each other.

The antenna device preferably has an antenna coil. With this antenna coil it is possible to build up an electromagnetic transmission path between the two hearing aids in the case of binaural hearing assistance.

The ITE hearing aid may be a so-called CIC hearing aid, which can be inserted completely in the auditory canal of the patient. This means that, because of the special alignment, the antenna can be fitted even in a CIC aid.

The ITE hearing aid typically has a mounting plate, the antenna device being arranged at an angle of 10° to 40° in relation to the perpendicular of the mounting plate. This angle is preferably at approximately 20° to 30°. This angle corresponds to the typical angle of inclination of the auditory canal in relation to the line joining the two ears of a patient. The mounting plates of the hearing aids, which are inserted in the patient's left and right ears, are usually aligned approximately parallel to each other. Therefore, if the antenna device has the aforementioned angle in relation to the mounting plate with its preferred direction of transmission, the directions of transmission of the two hearing aids in the fitted state lie on a straight line, the directions of transmission being opposed to each other. As a result, optimum transmission between the two antenna devices is possible with minimal expenditure of energy. In this respect it must be taken into account that the angles at which the antennas are fitted in the left and right hearing aids are of the same magnitude but have different algebraic signs.

A battery spring for the contacting of a hearing aid battery may be used as a holding means for the antenna device. For this purpose, an extension arm to which the antenna device can be fastened is attached to the battery spring. In this way, stable fastening of the antenna device can be ensured.

Alternatively, the fastening of the antenna device may take place on the programming contacts of the hearing aid. For this purpose, a special adapter to which the antenna device is fastened or can be fastened is fitted on the programming contacts. This fastening possibility may be of advantage in the case of specific hearing aid constructions if installation space for the antenna device is only available in the region of the programming contacts. In addition, this fastening variant has the advantage of simple assembly.

DESCRIPTION OF THE PREFERRED EMBODIMENTS

Figure 1:
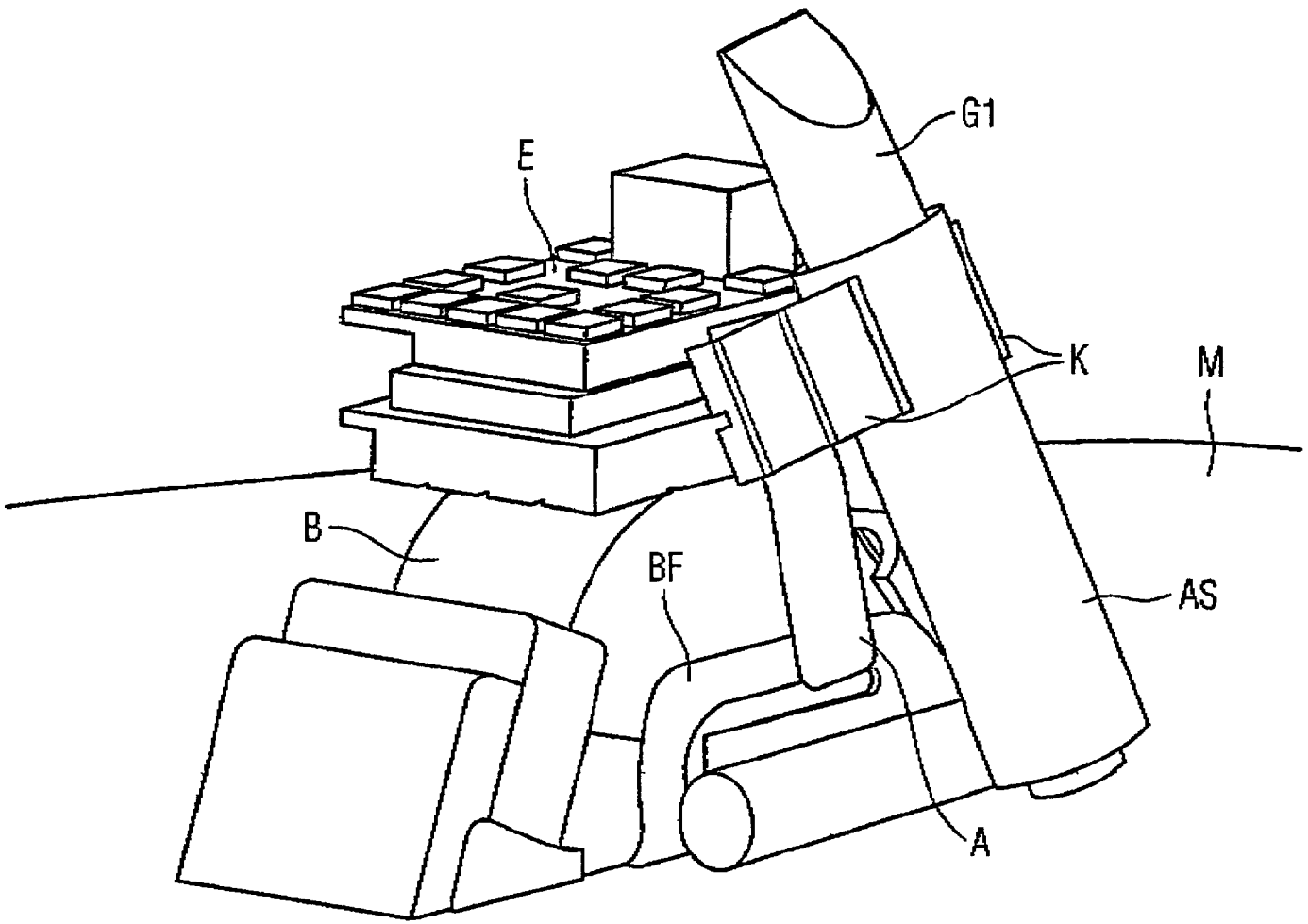
FIG. 1 is a perspective view of the electronic components of an ITE hearing aid mounted on a mounting plate, including the antenna, in accordance with the invention.

As shown in FIG. 1, electronic components of the hearing aid are fastened on a mounting plate M, which in the final state during the production of the hearing aid is individually cut to match the contour of the ear adapter and is referred to as a face plate. In particular, the battery B protrudes through the mounting plate M. It is held by a battery spring BF. Indicated above the battery B is an electronics module E.

Fastened to the battery spring BF is an extension arm A, on the distal end of which a clip K is mounted. The clip K holds an antenna coil AS. As a spacer with respect to the loudspeaker, a piece of soft rubber G1 is provided on the end face of the antenna coil AS, which face is in the vicinity of the clip K.

As can likewise be seen from FIG. 1, the extension arm A is angled away approximately in the region of its center, so that the desired angular position of the antenna coil AS with respect to the mounting plate is achieved. The fastening of the extension arm A to the battery spring BF may also take place at any desired angle. In this way it is possible to give the clip K, and therefore also the antenna coil AS, any desired spatial angle with respect to the mounting plate M or the vertical thereof.

Figure 2:
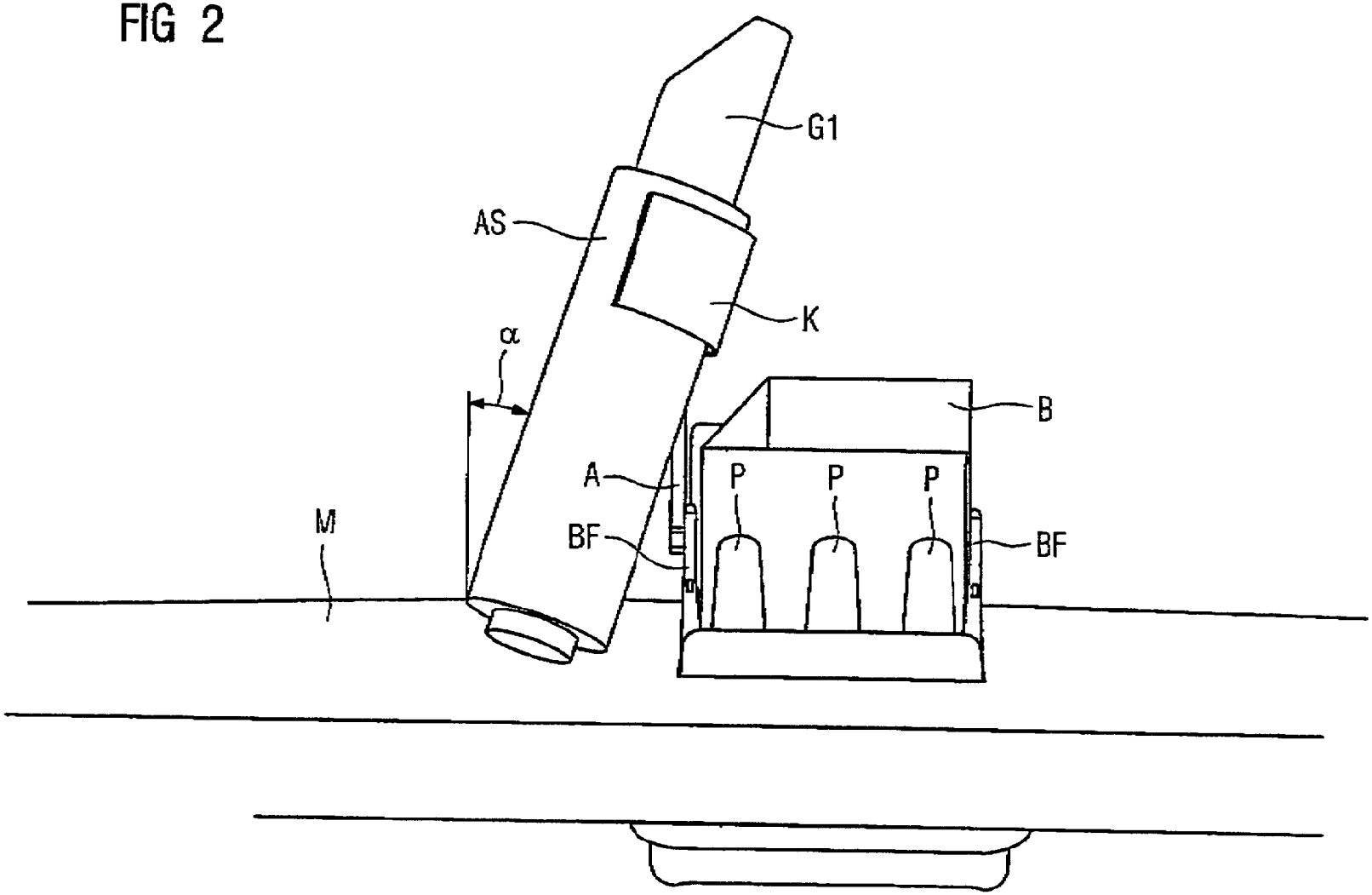
FIG. 2 shows a view of the electronic components from FIG. 1 from a different viewing angle.

In FIG. 2, the main components that are also represented in FIG. 1 are shown from a different perspective, while omitting the electronics module E for reasons of overall clarity. Here, the two battery springs BF between which the battery B is held can specifically be seen. Arranged on the left battery spring BF is the extension arm A, which keeps the antenna coil AS at the desired angle a with respect to the perpendicular of the mounting plate M. It can also be seen from FIG. 2 that the antenna coil AS is also tilted in a direction perpendicular to the plane of the drawing. Together with the angle a, this produces a specific spatial angle, which corresponds to the statistical auditory canal angle of the auditory canal in relation to the line joining the two ears of a patient. The prefered direction of tansmission of the antenna coil AS lies along its axis. Therefore, if the antenna coil AS is aligned in the way described in the hearing aid on one side of the hearing aid wearer and is aligned symmetrically thereto in the hearing aid on the other side of the hearing aid wearer, the two antenna coils are substantially coaxial to each other. Accordingly, the wireless connection between two antenna coils can be set up with minimal energy.

As an alternative to the extension arm A on the battery spring BF, an adapter which is fitted onto the mounting plate M of the hearing aid electronics may also be provided for securing the antenna coil AS at the desired angle. It goes without saying, however, that other components such as programming contacts P may also be provided for securing it at the desired angle.

To make the ITE hearing aid as small as possible and allow the antenna to be fitted in a defined manner, the antenna should be fitted such that it is set back with respect to the earphone or loudspeaker. The reason for this is that the hearing aids are substantially conically formed and therefore more installation space is available toward the outside, This problem occurs in particular in the case of CIC aids, which are inserted completely in the auditory canal, For assembly reasons, the securement of the antenna coil AS should be formed in such a way that the antenna coil is not damaged when it is fitted. The clip K represents a gentle means of securement of this type.

The ear adapters for ITE hearing aids are in principle custom-made. Therefore, a correspondingly different installation space is available in each hearing aid. In a series of fitting tests, it has therefore been found statistically on average to be favorable to fasten the antenna coil AS in the position next to the battery with a corresponding securement on the battery spring BF, as represented in FIG. 1 and FIG. 2. In this way, the typical base area of the faceplate cutout is not increased by the additional component, the antenna coil AS, Although modifications and changes may be suggested by those skilled in the art, it is the intention of the inventors to embody within the patent warranted hereon all changes and modifications as reasonably and properly come within the scope of their contribution to the art.

We claim as our invention:

1. An ITE hearing aid for binaural hearing assistance of a patient, comprising:

a housing configured to be received and held in one ear of a subject;

an antenna device having a single preferred transmission direction; and a mounting for said antenna device in said housing that orients said antenna device in said housing to cause said single preferred transmission direction, when said housing is received and held in said one ear of the subject, to be oriented substantially toward the other ear of the subject.

2. An ITE hearing aid as claimed in claim 1 wherein said antenna device comprises an antenna coil.

3. An ITE hearing aid as claimed in claim 1 wherein said housing is a CIC hearing aid housing.

4. An ITE hearing aid as claimed in claim 1 wherein said mount comprises a mounting plate in said housing, said antenna device being disposed at an angle in a range between 10° and 40° relative to the normal of said mounting plate.

5. An ITE hearing aid as claimed in claim 1 wherein said mount comprises a mounting plate in said housing, said antenna device being disposed at an angle in a range between 20° and 30° relative to the normal of said mounting plate.

6. An ITE hearing aid as claimed in claim 1 wherein said mount comprises a battery spring configured to contact a battery spring having an extension arm to which said antenna device is fastened.

7. An ITE hearing aid as claimed in claim 1 comprising an electronics module also mounted on said mount.

8. An ITE hearing aid as claimed in claim 7 comprising programming contacts for said electronics module, said programming contacts also being disposed on said mount.

* * * * *